US005685739A

United States Patent [19]

Davis et al.

[11] Patent Number: 5,685,739

[45] Date of Patent: Nov. 11, 1997

[54] SHIELDED ELECTRICAL CONNECTOR

[75] Inventors: Wayne Samuel Davis, Harrisburg; Michael Eugene Shirk, Grantville; Leung Man Shiu, Harrisburg, all of Pa.

[73] Assignee: The Whitaker Corporation, Wilmington, Del.

[21] Appl. No.: 601,636

[22] Filed: Feb. 14, 1996

[51] Int. Cl.[6] ..... H01R 13/648

[52] U.S. Cl. ..... 439/607; 439/79

[58] Field of Search ..... 439/78, 79, 92, 439/101, 108, 607, 608

[56] References Cited

U.S. PATENT DOCUMENTS

| | | | |
|---|---|---|---|
| 3,949,180 | 4/1976 | Ojima et al. | 200/51.1 |
| 4,457,576 | 7/1984 | Cosmos et al. . | |
| 4,582,384 | 4/1986 | Frantz et al. . | |
| 4,756,695 | 7/1988 | Lane et al. | 439/76 |
| 4,789,357 | 12/1988 | Yamaguchi et al. | 439/607 |
| 5,017,156 | 5/1991 | Sugiyama | 439/607 |
| 5,035,651 | 7/1991 | Dixon et al. | 439/609 |
| 5,073,130 | 12/1991 | Nakamura | 439/607 |
| 5,158,481 | 10/1992 | Frantz | 439/607 |
| 5,161,997 | 11/1992 | Defibaugh et al. | 439/532 |
| 5,267,882 | 12/1993 | Davis | 439/680 |
| 5,376,011 | 12/1994 | Rudy, Jr. et al. | 439/79 |
| 5,399,105 | 3/1995 | Kaufman et al. | 439/609 |
| 5,496,195 | 3/1996 | Reed | 439/607 |

FOREIGN PATENT DOCUMENTS

| | | | |
|---|---|---|---|
| 0627791 A1 | 12/1994 | European Pat. Off. | H01R 23/68 |
| 0670616 A1 | 9/1995 | European Pat. Off. | H01R 23/68 |
| WO 88/08627 | 11/1988 | WIPO | H01R 13/658 |

OTHER PUBLICATIONS

International Search Report, corresponding PCT application No. PCT/US97/02490; dated Jun. 11, 1997; two pages.

Abstract and Drawings; Ser. No. 60/000,273–Filed Jun. 16 1995.

Abstract and Drawings; Ser. No. 08/411,137–Filed Mar. 27 1995.

Abstract and Drawings; Ser. No. 60/003,852–Filed Sep. 15 1995.

Abstract and Drawings; Ser. No. 08/014,911–Filed Feb. 8 1993.

AMP Booklett 296065, Rev. D, "Connector System for the Universal Serial Bus", Dec. 1995; 27 pages; AMP Incorporated, Harrisburg, PA.

U.S. application No. 08/511,199 filed Aug. 4, 1995 (Abstract and Drawings only included).

*Primary Examiner*—Khiem Nguyen

*Attorney, Agent, or Firm*—Anton P. Ness

[57] ABSTRACT

An electrical receptacle connector (10) including a one-piece shell (12) affixed to a housing (14) and adapted to be mounted at an input/output port of an apparatus and on a circuit board within a panel. Shell (12) includes a front wall (66) that provides shielding of the mating interface adjacent the panel cutout(s), and an upper wall (62) and a lower wall (64) extending rearwardly from the front wall (66). Retention spring arms (70,94) extend from the upper and lower walls through recesses (34,56) into plug-receiving cavities (32) to engage and retain the mating connector in a mated condition, and ground legs (96) secure the connector to a circuit board. The connector may have a pair of plug-receiving cavities (32) divided by a vertical housing wall (112), and the lower shell wall (64) may comprise two portions (84) each receivable along a slot (60) above a bottom housing wall (54) to be insulated from a circuit board beneath the connector.

16 Claims, 5 Drawing Sheets

SHIELDED ELECTRICAL CONNECTOR

FIELD OF THE INVENTION

The present invention relates to electrical connectors and more particularly to shielded connectors.

BACKGROUND OF THE INVENTION

Shielded connectors are known that have a conductive shell secured around an insulative housing, and an array of contacts disposed in the housing, extending from a mating face to a board mounting face, with the connector and its contacts adapted for right angle mounting on a circuit board. A conductive shell is disposed to surround the housing for shielding from electromagnetic interference (EMI), and includes legs defining ground contacts connectable to ground circuits of the circuit board upon connector mounting thereto.

In a mating connector assembly sold by AMP Incorporated, Harrisburg, Pa., as the "Universal Serial Bus", the receptacle connector (Part Nos. 95-8099-23-1) defines a single cavity and includes a one-piece shell member having upper and lower walls joined to side walls, thus surrounding the housing, with spring arms extending forwardly and inwardly into the plug-receiving cavity to free ends formed to seat in recesses into the outer surfaces of the plug connector (Part No. 95-8083-19-1) for mating condition retention. Ground contact spring arms extend inwardly and rearwardly from the side walls to engage the plug shell upon mating. Depending legs define board retention sections as well as serve as ground connections to circuits of the circuit board onto which the receptacle connector is mounted. Coplanar flanges extend laterally outwardly from the upper and lower and side walls at forward edges thereof to surround a panel cutout aligned with the plug-receiving cavity.

In a stacked receptacle connector (Part No. 95-3942-1-1) a pair of plug-receiving cavities are in a vertically stacked arrangement within a housing, and a shell member surrounds the upper, lower and side walls of the housing with retention arms extending inwardly and forwardly from the upper and lower walls to retentively engage the respective plug connectors, ground contacts along the side walls, and board-retention ground contact legs along the bottom wall; a separate clip member is inserted into the housing to provide additional retention arms opposed to those of the shell member.

It is desired to provide enhanced shielding along the mating face of a receptacle connector mounted at an input/output port of an apparatus.

It is further desired to provide for mated connector retention, assured grounding shield-to-shield engagement and board retention and chassis ground in a one-piece member for a dual cavity receptacle connector.

SUMMARY OF THE INVENTION

It is an objective of the present invention to provide a shielded connector containing a pair of mating positions positioned side-by-side, adapted to be mounted to a circuit board at an input/output port of an electronic apparatus, with a shell member providing assured shielding thereat.

A receptacle connector includes a shell member of the present invention secured thereto, and is adapted to be mounted to a circuit board within an apparatus at an input/output port thereof. The shell provides EMI shielding of the signal contacts of the connector in two (or more) plug-receiving cavities along a connector mating face at the input/output port at a conductive panel of the apparatus. The shell member is stamped and formed of a single piece to have an upper wall and lower wall, extending rearwardly from a common front wall having apertures therethrough aligned with respective panel cutouts to provide entry into the plug-receiving cavities.

The shell member inherently acts to retain plugs inserted into the cavities for connector mating, by providing spring arms extending from the upper and lower walls inwardly and forwardly within the cavities for appropriately shaped free ends to become seated into recesses into outer surfaces of the plug. The shell member also includes shell-engageable ground fingers extending rearwardly from the front wall along sides of the cavities to free ends engageable with conductive shells of the plugs, and also includes ground contacts in the form of legs depending from the bottom wall to be insertable into holes of the circuit board serving as termini of ground circuits of the board connected with chassis ground in the apparatus, the ground legs thus being able to serve as board retention members. All features of the shell member are defined on the upper, lower and front walls so that no side walls are necessary nor openings through the housing side walls for such features, thus enabling minimized connector width.

In another aspect of the present invention, the shell member is affixed to the insulative housing in a manner to be insulated from signal circuits of a circuit board onto which the connector is mounted, by its bottom wall comprising two spaced portions each extending rearwardly from the mating face within slots adjacent the plug-receiving cavities, thus being disposed above a bottom wall of the housing and enabling minimal spacing between the connector's board-mounting face and the board. Optionally, the shell member further may include forwardly angled tabs depending from the front wall offset from the rearwardly extending bottom wall portions, to engage the conductive panel adjacent the panel cutouts for grounding.

An embodiment of the invention will now be described by way of example with reference to the accompanying drawings.

DETAILED DESCRIPTION

Figure 1:
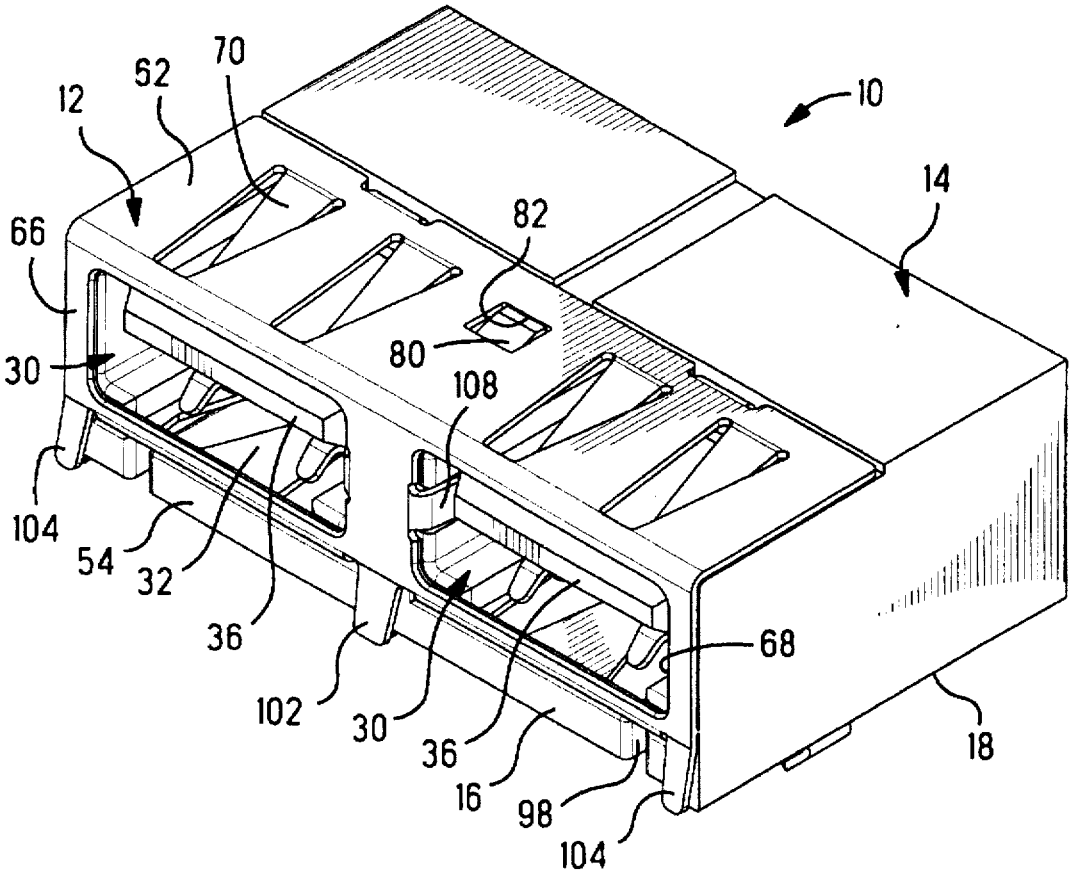
FIG. 1 is an isometric view of the connector along the mating face.

Connector 10 of FIGS. 1 to 5 includes a shell 12 mounted on a housing 14, and has a mating face 16 and a board mounting face 18. Two arrays of discrete contact members 20 are provided associated with two mating portions 30 of the connector, positioned side-by-side along the mating face, with each mating portion for mating with a plug portion of a respective mating connector at an input/output port of an electronic apparatus. Each array of contacts may include for example, signal contacts, a power contact and a ground contact. Connector 10 is adapted to be mounted onto a circuit board and to be used at an input/output port having a pair of cutouts through a panel of the apparatus for insertion therethrough of respective mating connectors, and shell 12 provides shielding of the connector at the cutouts.

Figure 2:
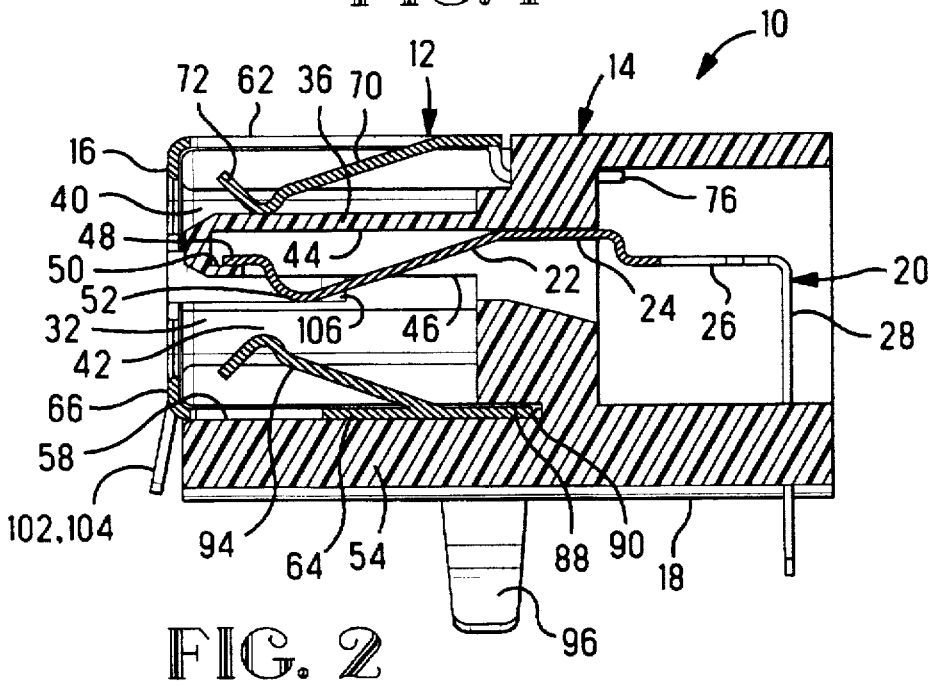
FIG. 2 is a longitudinal section view of the connector.
Figure 3:
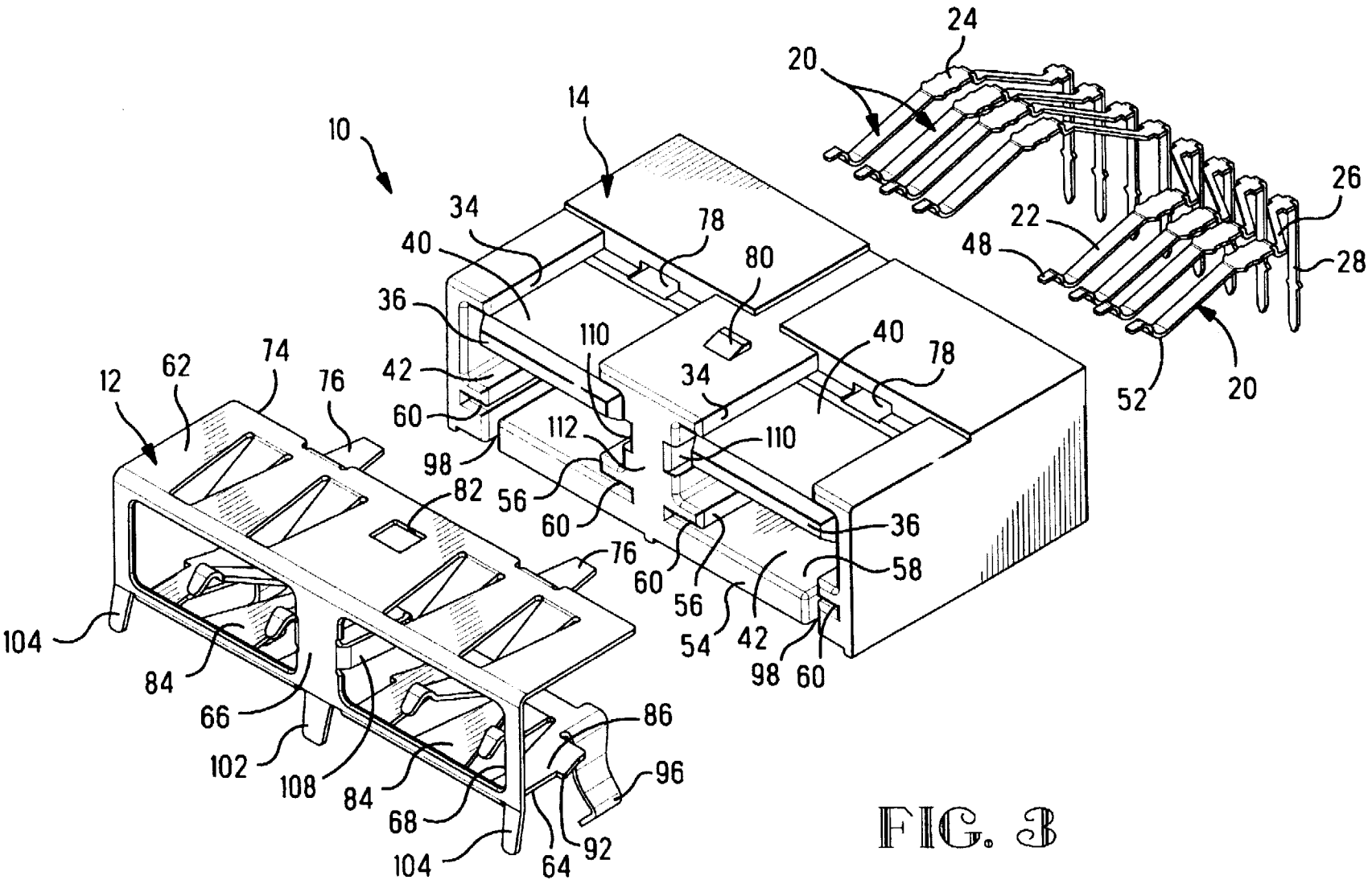
FIG. 3 is an exploded isometric view of the connector of FIGS. 1 and 2 with the shell and the contacts exploded form the housing.
Figure 4:
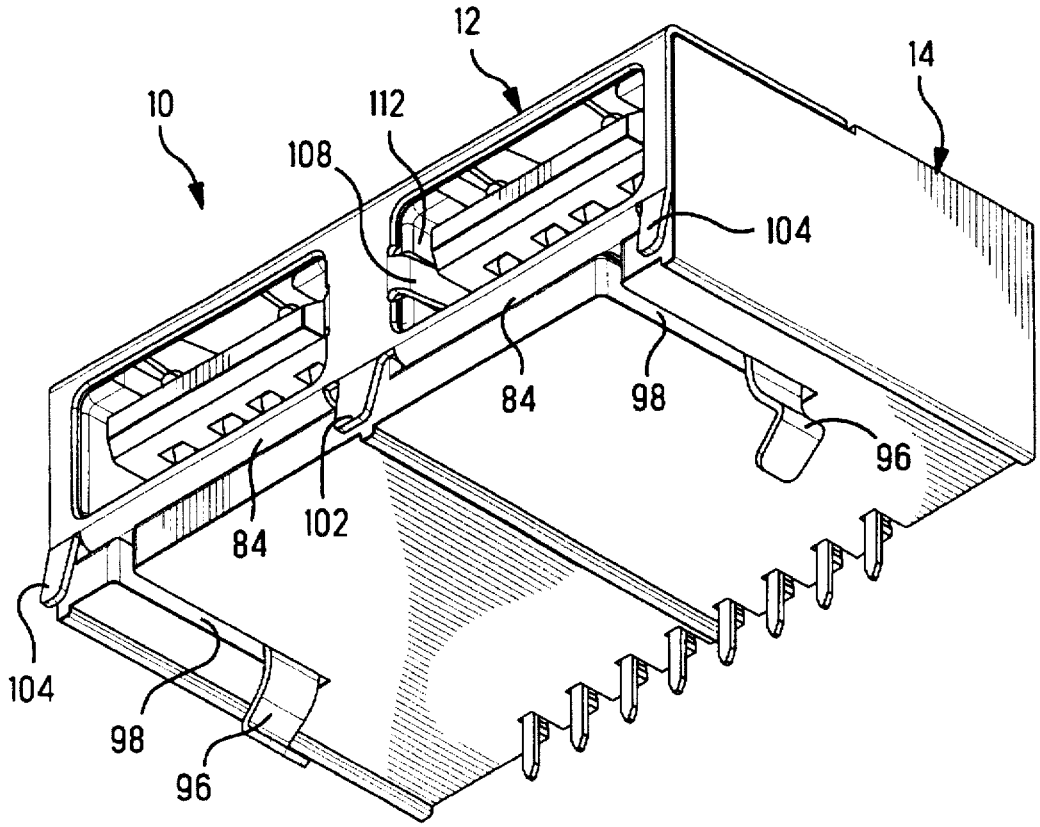
FIGS. 4 and 5 are isometric views of the connector from below and from rearwardly thereof.
Figure 5:
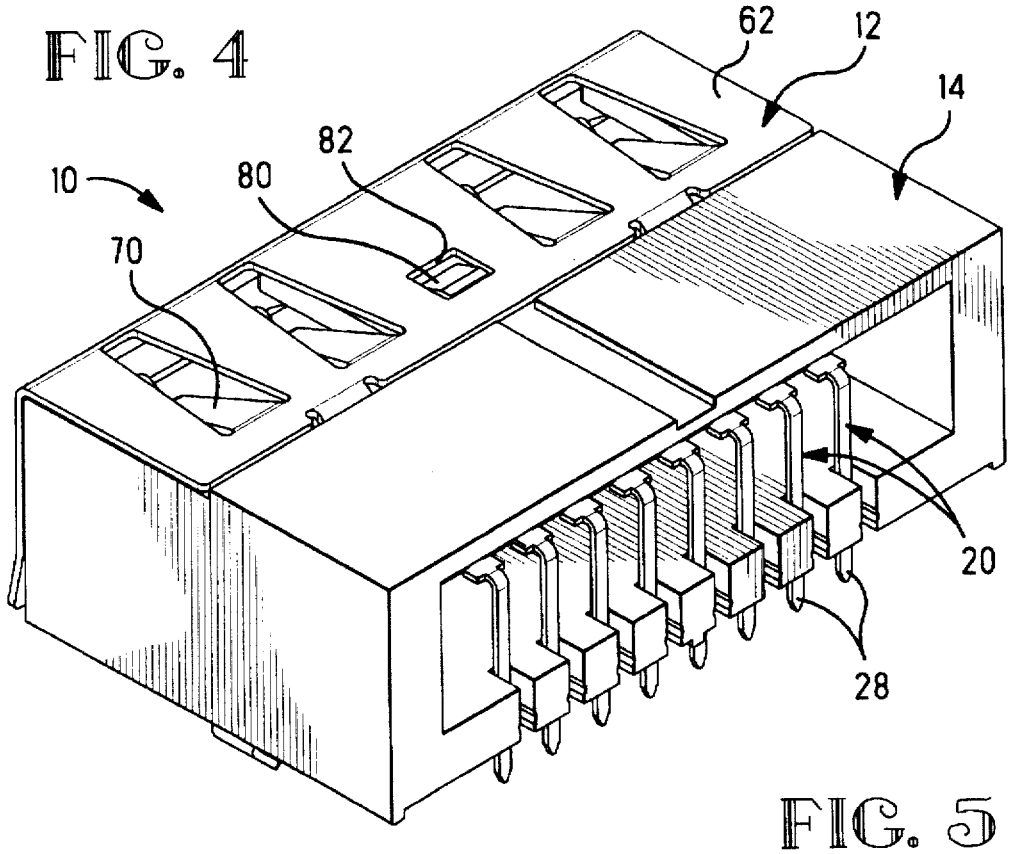
Figure 6:
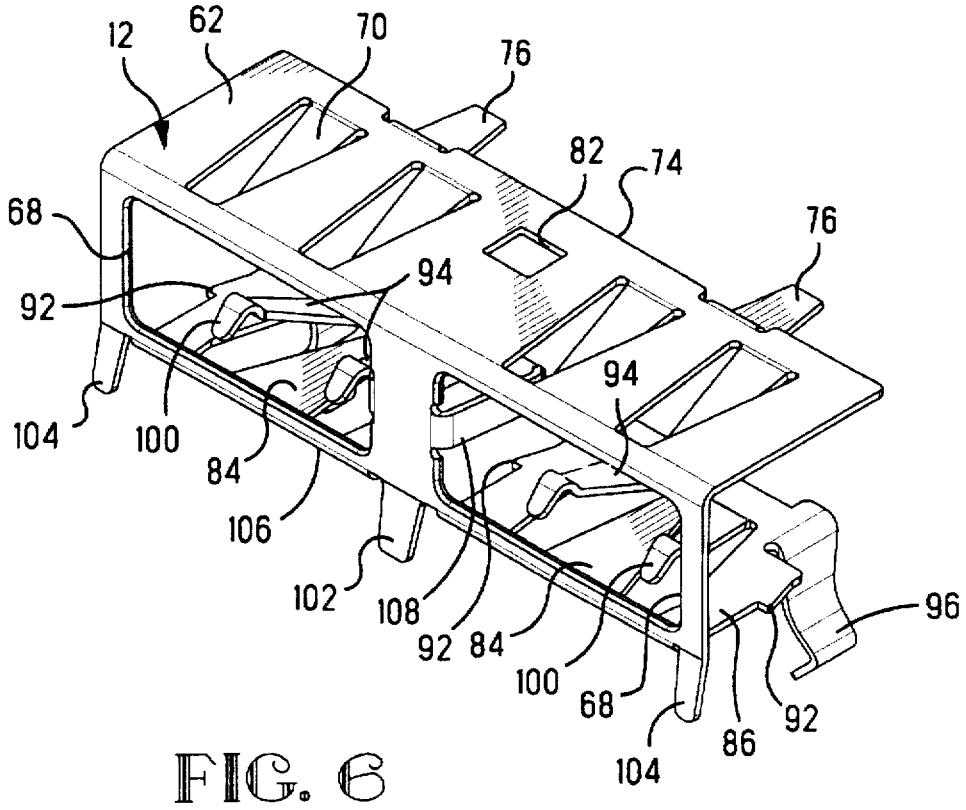
FIGS. 6 and 7 are isometric views of the shell of FIG. 3 from forwardly and rearwardly respectively.

Discrete contacts 20 are seen in FIGS. 2 and 3 to each have a spring arm contact section 22 extending forwardly from a body section 24, and transition sections 26 extending rearwardly therefrom to a post section 28 depending from a right angle bend to extend beyond board-mounting face 18 to be insertable into through-holes of a circuit board (not shown). Transition sections 26 are angled to position the post sections 28 in a single row spaced apart a regular spacing distance through positioning grooves (FIG. 5). Body sections 24 are shown to preferably include retention barbs to retentively engage side walls of passageways through the housing upon contact insertion.

Housing 14 is seen in FIGS. 2 and 3 to provide a pair of plug-receiving cavities 32 at respective mating portions 30, extending rearwardly from mating face 16. Upper surface of housing 14 includes recesses 34 in communication with respective cavities 32. A divider wall 36 is positioned medially across each cavity 32 and opposed to recess 34, dividing the cavity into upper and lower portions 40,42. Contact arms 22 of the discrete contacts 20 are disposed in the lower cavity portions 42 and in channels 44 along the bottom surface 46 of divider wall 36, with free ends 48 trapped under lip 50 at the front end of divider wall 36 while permitting arcuate contact sections 52 to extend into lower cavity portion 42 to be engaged by complementary contacts of a mating connector (not shown) and deflected upwardly toward divider wall 36. It is seen that the housing provides the surfaces engaged by a mating plug connector inserted into a respective cavity to facilitate positioning and guiding the plug connector to full mating.

Housing 14 includes a bottom wall 54 along the board mounting face extending beneath both lower cavity portions 42, and recesses 56 are formed extending from lower cavity portions 42 to inner surface 58 of bottom wall 54. Pairs of guide channels 60 extend laterally outwardly from recesses 56 and along inner surface 58.

Shell 12 is stamped and formed of a unitary piece from a sheet metal blank to have an upper wall 62 and a lower wall 64 extending rearwardly from front wall 66. Apertures 68 are provided through front wall 66 associated with the two mating portions 30. A pair of first spring arms 70 extend forwardly from a rear section of upper wall 62 and are angled downwardly to extend into one of recesses 34 toward and preferably biased against the upper surface of divider wall 36, with an upwardly angled free end 72 adapted to be engaged by a front plug end of a mating connector for upward deflection during connector mating, and thereafter be biased against a top surface of the conductive shell of the mating plug connector (not shown) during mating and finally seating within recesses therealong to establish retention of the connectors in a mated condition. Preferably free ends 72 are appropriately shaped for latching by being bent so as to effectively define rearwardly facing retention surfaces adapted to latchingly engage an adjacent oppositely facing side wall of a respective recess into the top surface of a plug connector upon full mating.

Figure 7:
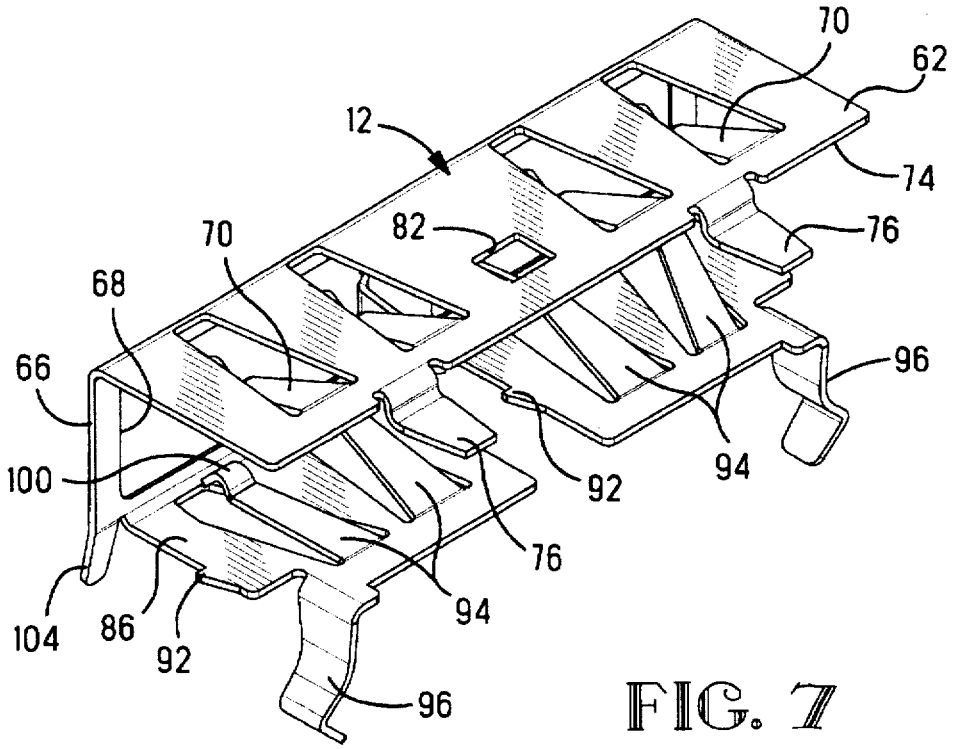
Figure 8:
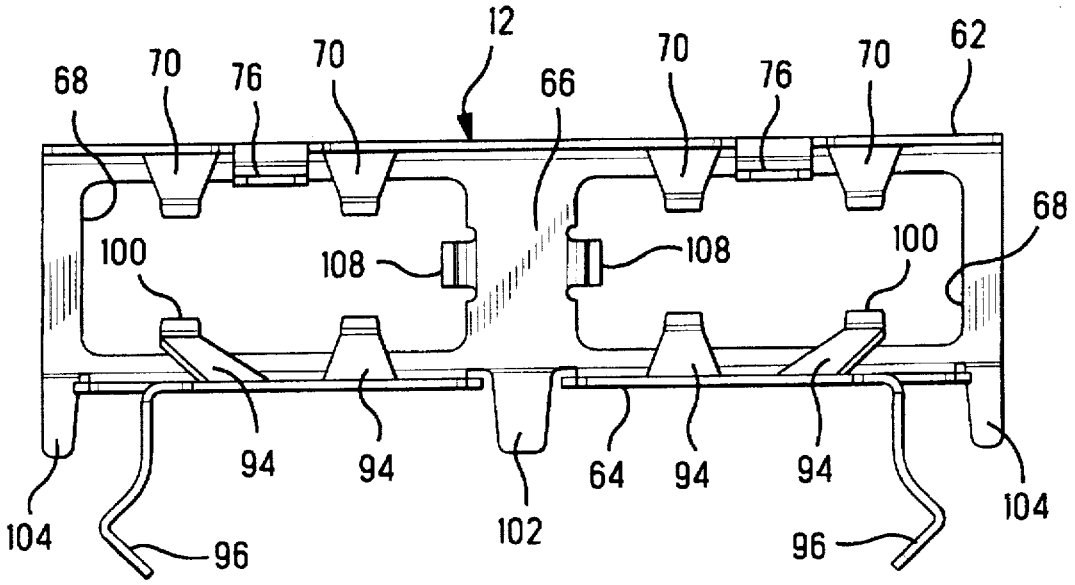
FIG. 8 is a rear elevation view of the shell of FIGS. 3, 6 and 7.
Figure 9:
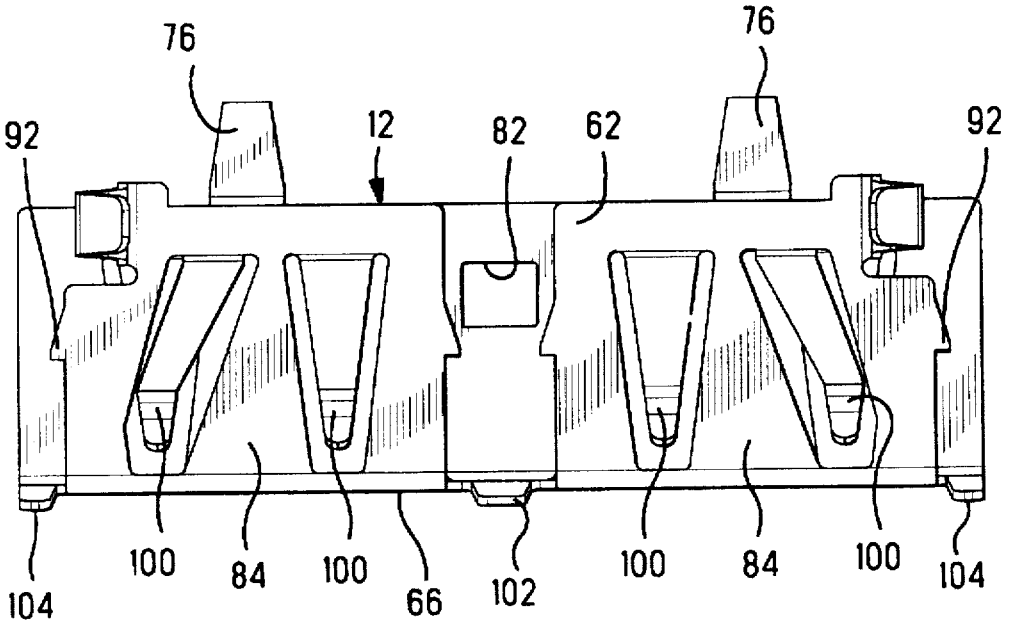
FIG. 9 is a bottom plan view of the shell of FIGS. 3 and 6 to 8.

Extending rearwardly from upper shell wall 62 at its rear edge 74 are retention tabs 76 (best seen in FIG. 7) that are offset downwardly from the plane of upper shell wall 62 to be insertable into slots 78 (see FIG. 3) into housing 14 extending rearwardly from upper cavity portion 40. A primary shell-to-housing retention mechanism is provided in the form of a latching projection 80 extending upwardly from the top surface of housing 14 between recesses 34, latchingly received into an aperture 82 in upper shell wall 62.

Lower shell wall 64 is adapted to be received into housing 14 above a bottom housing wall, thus being insulated from any circuits of a circuit board onto which connector 10 is mounted; such insulation permits minimized spacing between the connector mounting face and the circuit board. Lower shell wall 64 comprises a pair of wall sections 84 associated with respective ones of lower cavity portions 42, and side portions 86 thereof are received along guide channels 60. Rear end sections 88 of lower shell wall sections 84 are received into a slot 90 extending rearwardly from lower cavity portion 42 (FIG. 2). Also, lower shell wall sections 84 include retention barbs 92 extending outwardly from side edges thereof to bite into and retentively engage lateral walls of guide channels 60 to assist in preventing forward movement of shell 12 with respect to housing 14 during in-service use when connector 10 is being unmated from the plug connector.

A pair of second spring arms 94 extend forwardly from a rear section of each lower shell wall section 84 and upwardly into both lower cavity portions 42 opposed and spaced from contact sections 52 of signal contacts 20, thus being adapted to assist first spring arms 70 in retaining a plug connector within the plug-receiving cavity upon mating, by appropriately shaped free ends entering recesses into the bottom surface of the plug connector. Board-mounting ground contacts or legs 96 depend from lower shell wall sections 84 along an outer side edge thereof to be inserted into through-holes of a circuit board (not shown) upon connector mounting thereto; slots 98 in bottom housing wall 54 extend rearwardly from mating face 16 for receipt of board-mounting legs 96 when shell 12 is being assembled to the housing, best seen in FIG. 4.

It can be seen in FIGS. 6 to 9 that the forming of board-mounting sections 96 at rear sections of lower shell wall portions 84 necessitates that outer ones of second spring arms 94 must extend not only forwardly and upwardly but laterally outwardly at an angle from their bases along the rear sections of lower shell wall sections 84 to position the contact sections 100 thereof properly spaced from the contact sections of the other second ground contacts of each pair and opposed from a contact section 52 of a signal contact 20.

Front wall 66 provides shielding from the immediate periphery of each plug-receiving cavity entrance to beyond the periphery of a correspondingly dimensioned panel cutout associated with each cavity, thus providing enhanced shielding of the mating interface at the cutout. Preferably, front wall 66 of shell 12 includes several lances 102,104 depending from a lower edge 106 and angled slightly forwardly, engageable with wall surfaces of the panel of an electronic apparatus at an input/output port thereof to define ground connections therewith when mounted in abutment with the panel wall. Central lance 102 is located centrally and between lower wall sections 84, and outer lances 104 are formed outwardly of the outer edges of lower wall sections 84, all so that shell 12 may be formed from a single sheet of metal to define all necessary and advantageous features thereof. Within each of lower cavity portions 42 is a shell-engaging finger 108 extending rearwardly along a channel 110 from front shell wall 66 along a medial wall 112 of the housing between the lower cavity portions 42, with the fingers 108 angled slightly outwardly from the medial wall to assuredly engage side surfaces of the conductive shells surrounding plug portions of mating connectors (not shown).

It is an option that side walls may easily be formed from the blank from which the shell member of the present invention is formed, if additional side wall connector shielding is desired, without interfering with any of the retention or grounding sections of the shell. It may also be seen that additional panel-engaging fingers could similarly be formed along side edges of the front wall. Other such variations and modification may be made that are within the spirit of the invention and the scope of the claims.

What is claimed is:

1. A shielded receptacle connector, comprising:

an insulative housing providing at least one plug-receiving cavity and containing at least one signal contact extending from a mating face to another connecting face each including a contact section disposed within a respective said plug-receiving cavity for engagement with a complementary contact of a mating connector, and a one-piece shell affixed to the housing and including a front wall, an upper wall extending rearwardly from the front wall, and a lower wall extending rearwardly from the front wall, the front wall including an aperture aligned with and surrounding each said plug-receiving cavity of said housing, the shell including at least one spring arm defined along the upper wall and extending forwardly from a rear section thereof and inwardly through an upper housing recess and into a respective said plug-receiving cavity to a free end positioned to be engaged by an upper surface of a mating connector inserted into the cavity, the shell including at least one spring arm defined along the lower wall and extending forwardly from a rear section thereof and inwardly through a lower housing recess and into a respective said plug-receiving cavity to a free end positioned to be engaged by a lower surface of the mating connector, and the shell further including at least one ground contact extending from the lower wall to be exposed for establishing a chassis ground, all of the spring arms and the at least one ground contact extending from the upper and lower walls such that the shell need not provide side walls.

2. The connector as set forth in claim 1 wherein each said at least one ground contact is a leg depending from the lower wall and is adapted to establish a mechanical connection with a circuit board to provide retention of the connector to the circuit board upon insertion through a hole thereof.

3. The connector as set forth in claim 1 wherein the front wall includes tabs angled forwardly from locations laterally offset from all portions of said bottom wall, engageable with portions of a panel peripheral to cutouts therethrough aligned with said plug-receiving cavities.

4. The connector as set forth in claim 1 wherein one of said upper and lower walls includes an aperture therethrough associated with a latching projection of said housing upon assembly thereto, for retention of the shell to the housing, and said one of said upper and lower walls includes at least one section engageable with the housing to secure said one of said upper and lower walls against an adjacent outer surface of the housing.

5. The connector as set forth in claim 1 wherein the shell includes two said upper spring arms associated with each said plug-receiving cavity and two said lower spring arms associated with each said plug-receiving cavity.

6. The connector as set forth in claim 5 wherein board-engaging ground legs are bent down from side edges of said shell lower wall adjacent a rear edge thereof, and outer ones of said lower spring arms extend forwardly and angled outwardly from said rear section adjacent respective said ground legs for free ends of said outer spring arms to be positioned adjacent said side edges of said shell lower wall forwardly of said ground legs.

7. The connector as set forth in claim 1 wherein the shell lower wall comprises separate portions extending rearwardly from the front wall beneath each said plug-receiving cavity, with a spacing therebetween aligned with a vertical wall of the housing dividing adjacent ones of said plug-receiving cavities.

8. The connector as set forth in claim 7 wherein each said shell lower wall portion extends along a horizontally oriented slot extending into the housing from said mating face beneath an associated said lower recess below a respective said plug-receiving cavity to be disposed above a bottom wall of the housing along a board-mounting face thereof, and each said ground leg passes along and through a vertical slot in communication with said mating face and said board-mounting face and a respective said lower recess during assembly of the shell to the housing from forwardly thereof, such that said shell lower wall portions are insulated from any circuits of the circuit board upon connector mounting thereto enabling the space between the circuit board and the board-mounting face to be minimized.

9. The connector as set forth in claim 8 wherein the housing includes two said plug-receiving cavities arrayed laterally across the mating face, the shell front wall includes two said apertures therethrough aligned with respective said plug-receiving cavities, and the shell lower wall comprises two said portions.

10. The connector as set forth in claim 8 wherein said shell lower wall includes an aperture therethrough associated with a latching projection of the housing upon assembly thereto, and side edges of each said shell bottom wall portion include outwardly extending barbs adapted to bite into adjacent wall portions of respective ends of said horizontally oriented slots along which said side edges extend, all together providing resistance to forward movement of the shell relative to the housing after assembly.

11. A shielded receptacle connector, comprising:

an insulative housing providing at least one plug-receiving cavity and containing at least one signal contact extending from a mating face to a board-mounting face each including a contact section disposed within a respective said plug-receiving cavity for engagement with a complementary contact of a mating connector, and a shell affixed to the housing and including a front wall, an upper wall extending rearwardly from the front wall, and a lower wall extending rearwardly from the front wall parallel to and proximate said board-mounting face thereof, the front wall including an aperture aligned with and surrounding each said plug-receiving cavity of the housing, and said shell lower wall extends along a horizontally oriented slot extending into the housing from said mating face beneath said at least one plug-receiving cavity to be disposed above and along an upwardly facing surface of a bottom wall of the housing along said board-mounting face thereof, such that said shell lower wall is insulated from any circuits of a circuit board upon connector mounting thereto enabling the space between the circuit board and the board-mounting face to be minimized.

12. The connector as set forth in claim 11 wherein ground legs are bent down from side edges of said shell lower wall adjacent a rear edge thereof and said housing bottom wall includes a vertical slot associated with each said ground leg and in communication with said mating face and said board-mounting face and said horizontally oriented slot, permitting passage therealong of said associated ground leg during assembly of the shell to the housing.

13. The connector as set forth in claim 12 wherein the housing includes two said plug-receiving cavities arrayed laterally across the mating face, the shell front wall includes two said apertures therethrough aligned with respective said plug-receiving cavities, and the shell lower wall comprises two portions each receivable into a respective said horizontally oriented slot with side edges of each said portion disposed adjacent a wall of an associated end of a said horizontally oriented slot.

14. The connector as set forth in claim 13 wherein said shell lower wall includes an aperture therethrough associated with a latching projection of the housing upon assembly thereto, and said side edges of each said shell shell lower wall portion include outwardly extending barbs adapted to bite into said adjacent walls of respective ends of said horizontally oriented slots along which said side edges extend, all together providing resistance to forward movement of the shell relative to the housing after assembly.

15. The connector as set forth in claim 13 wherein the housing includes a lower recess extending from each said plug-receiving cavity in communication with a respective said horizontally oriented slot, and the shell includes at least one spring arm defined along the lower wall and extending forwardly from a rear section thereof and inwardly through a respective said lower housing recess and into a respective said plug-receiving cavity to a free end positioned to be engaged by a lower surface of the mating connector.

16. The connector as set forth in claim 1 wherein said shell further includes a shell-engaging finger disposed within each said plug-receiving cavity and extends rearwardly from said front wall at a periphery of a respective said aperture aligned with an entrance to each said plug-receiving cavity.

* * * * *